US009227460B2

(12) United States Patent
Chen

(10) Patent No.: US 9,227,460 B2
(45) Date of Patent: Jan. 5, 2016

(54) RECIPROCATING PENCIL SHARPENER

(75) Inventor: Szu-Yu Chen, Chang Hua (TW)

(73) Assignee: SDI CORPORATION, Chang Hua (TW)

( * ) Notice: Subject to any disclaimer, the term of this patent is extended or adjusted under 35 U.S.C. 154(b) by 1019 days.

(21) Appl. No.: 13/356,024

(22) Filed: Jan. 23, 2012

(65) Prior Publication Data

US 2012/0192995 A1 Aug. 2, 2012

(30) Foreign Application Priority Data

Jan. 27, 2011 (TW) ..... 100102997 A

(51) Int. Cl.
*B43L 23/08* (2006.01)
*B43L 23/00* (2006.01)

(52) U.S. Cl.
CPC ..... *B43L 23/08* (2013.01); *B43L 23/008* (2013.01)

(58) Field of Classification Search
CPC ..... B43L 23/00; B43L 23/002; B43L 23/004; B43L 23/006; B43L 23/008; B43L 23/02; B43L 23/06; B43L 23/08; B43L 23/085
See application file for complete search history.

(56) References Cited

U.S. PATENT DOCUMENTS

| | | | | |
|---|---|---|---|---|
| 2,307,119 | A * | 1/1943 | Duany | 144/28.11 |
| 5,394,613 | A | 3/1995 | Ku | |
| 7,384,190 | B2 | 6/2008 | Zimmermann | |
| 8,337,077 | B2 | 12/2012 | Giacobina | |

FOREIGN PATENT DOCUMENTS

| | | | |
|---|---|---|---|
| DE | 102006013471 | | 9/2007 |
| EP | 1586960 | | 10/2005 |
| EP | 2392975 | | 12/2011 |
| GB | 2035910 | A | 6/1980 |
| GB | 2205788 | A | 12/1988 |
| GB | 2289445 | A | 11/1995 |
| JP | 2003251996 | A | 9/2003 |

* cited by examiner

*Primary Examiner* — Matthew G Katcoff
(74) *Attorney, Agent, or Firm* — patenttm.us

(57) ABSTRACT

A reciprocating pencil sharpener has a stationary member, a cutter and a ratchet mechanism. The cutter includes a blade secured to a blade holder. The ratchet mechanism is mounted between the stationary member and the cutter and allows the cutter to rotate relative to the stationary member in one direction only. When a user desires to sharpen a pencil, the user can keep the pencil in the hand and rotate the pencil in reciprocating rotation, thus obtaining the sharpened point of the pencil. Consequently, it is convenient for the user to apply a rotational force and a high efficiency of sharpening operation is achieved.

21 Claims, 17 Drawing Sheets

RECIPROCATING PENCIL SHARPENER

BACKGROUND OF THE INVENTION

1. Field of the Invention

The present invention relates to a pencil sharpener, and more particularly to a reciprocating pencil sharpener to facilitate applying a rotational force and to perform an efficient pencil sharpening operation.

2. Description of the Prior Arts

A pencil sharpener is a device for sharpening the point of a pencil. A conventional pencil sharpener comprises a blade holder and a blade. The blade holder includes a conical bore therein to receive the point of a pencil. The blade is secured to the blade holder so that its cutting edge enters the conical bore. When it is desired to sharpen a pencil, the point of the pencil is inserted into the conical bore of the blade holder. The pencil is then rotated against the blade which cuts away the wood and lead of the pencil, thus sharpening the pencil.

However, the pencil must be rotated in continuous unidirectional rotation to be sharpened, and human wrists have limited ranges of motion. Thereby, after a user's hand holding the pencil rotates an angle, the hand should loosen and re-hold the pencil again to repeat rotating motion until sharpening operation is achieved. Each time re-holding the pencil changes the point of application of a rotational force. Re-holding the pencil frequently makes it difficult to apply a rotational force, affects the smoothness of pencil sharpening operation and thus reduces the efficiency of pencil sharpening operation.

To overcome the shortcomings, the present invention provides a reciprocating pencil sharpener to mitigate or obviate the aforementioned problems.

SUMMARY OF THE INVENTION

The main object of the present invention is to provide a reciprocating pencil sharpener to facilitate applying a rotational force and to perform an efficient pencil sharpening operation.

To achieve the foregoing objective, the reciprocating pencil sharpener in accordance with the present invention comprises a stationary member, a cutter and a ratchet mechanism. The cutter includes a blade secured to a blade holder. The ratchet mechanism is mounted between the stationary member and the cutter, allows the cutter to rotate in a drive direction and prevents the cutter from rotating in a non-drive direction relative to the stationary member. When a user desires to sharpen a pencil, the user can keep the pencil in the hand and rotate the pencil in reciprocating rotation, thus obtaining the sharpened point of the pencil. Consequently, it is convenient for the user to apply a rotational force and a high efficiency of sharpening operation is achieved.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
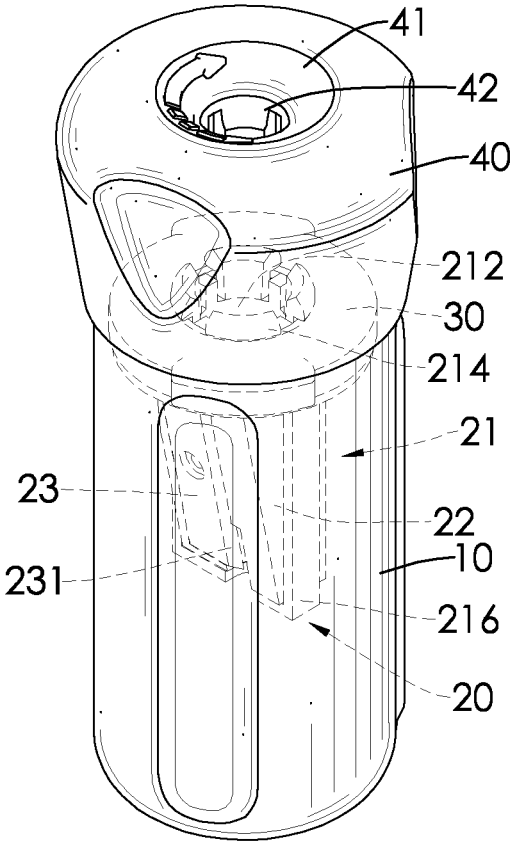
FIG. 1 is a perspective view of a first embodiment of a reciprocating pencil sharpener in accordance with the present invention.
Figure 2:
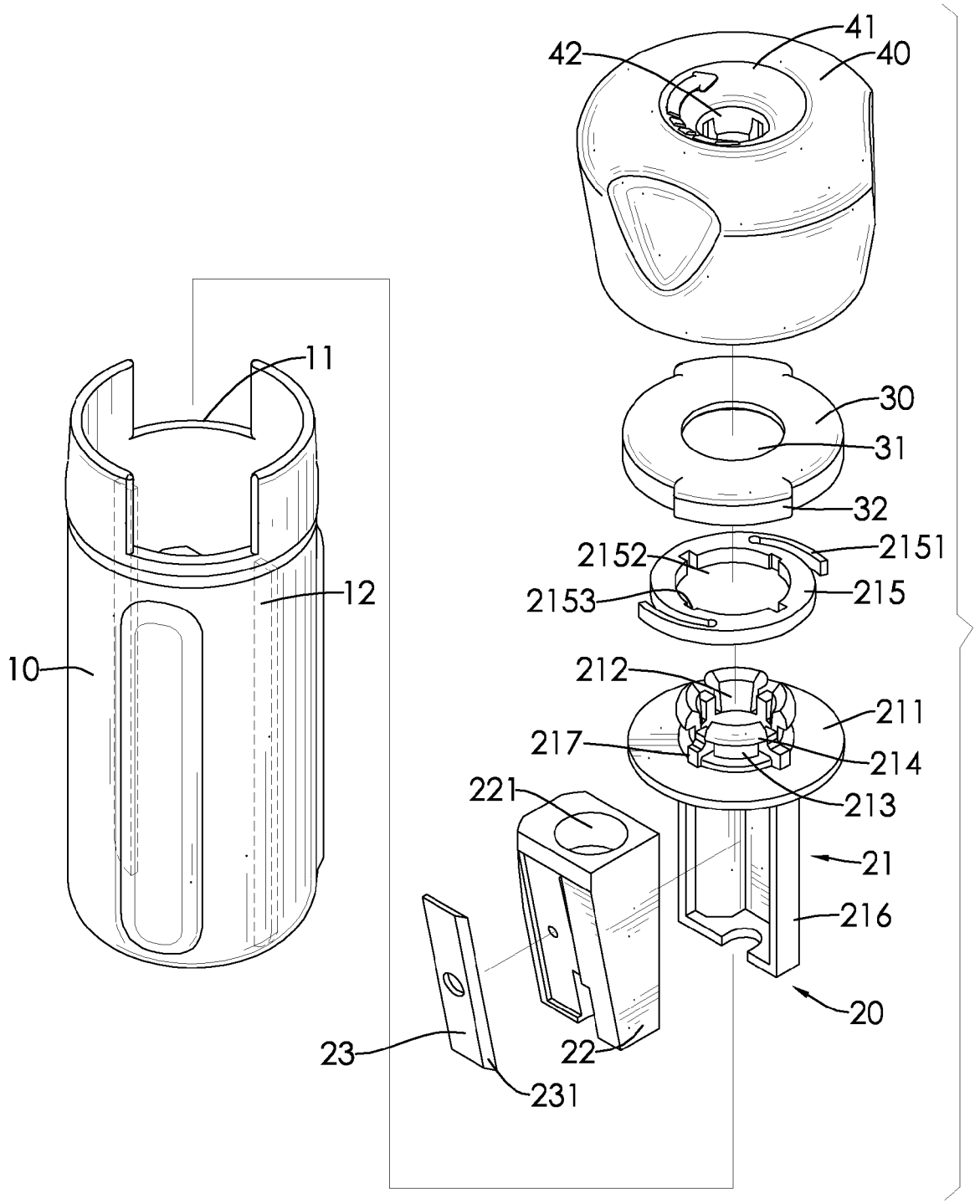
FIG. 2 is an exploded perspective view of the first embodiment of the reciprocating pencil sharpener in FIG. 1.
Figure 3:
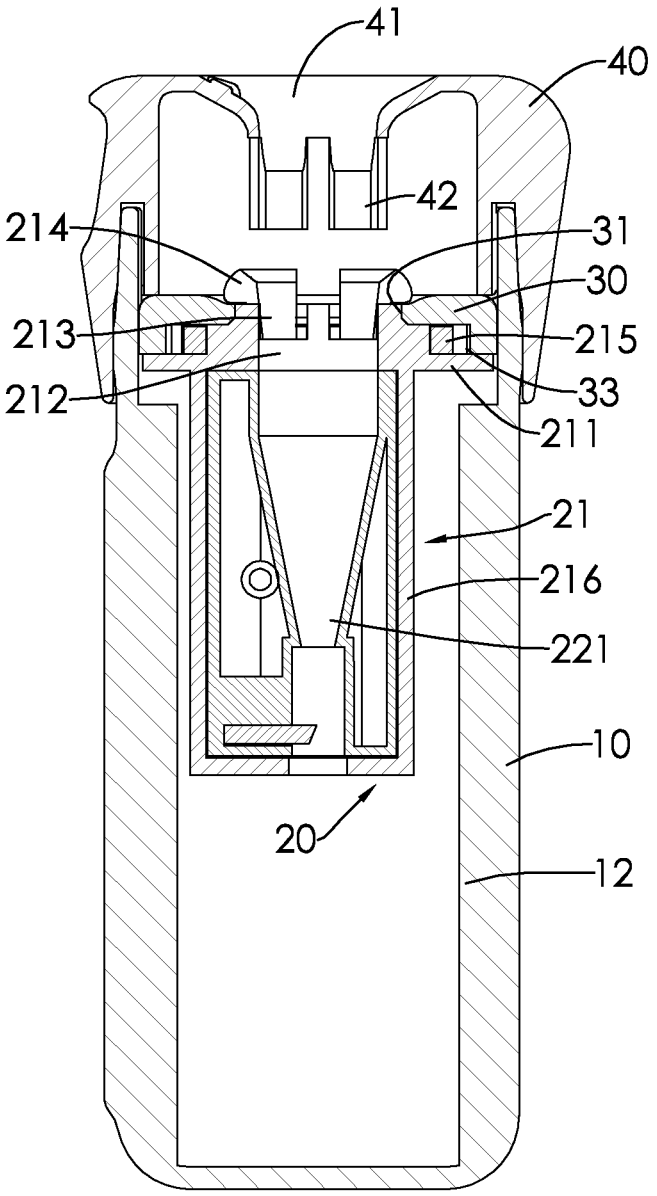
FIG. 3 is a cross-sectional side view of the first embodiment of the reciprocating pencil sharpener in FIG. 1.

With reference to FIGS. 1 to 3, a reciprocating pencil sharpener in accordance with the present invention comprises a shavings receptacle 10, a stationary member 30, a cutter 20, a ratchet mechanism and a cover 40.

The shavings receptacle 10 is tubular and includes a tube wall, an open top, a closed bottom and a plurality of fins 12. The fins 12 extend radially inwardly from an internal surface of the tube wall.

The stationary member 30 is detachably mounted in the shavings receptacle 10, is a plate and includes an upper surface, a lower surface, a center and a mounting hole 31. The mounting hole 31 is formed through the center of the stationary member 30.

The cutter 20 is detachably attached to the stationary member 30 and is rotatably disposed in the shavings receptacle 10. The cutter 20 may be a planing tool and includes a rack 21, a blade holder 22 and a blade 23. The rack 21 has a plate 211, a central hole 212, at least one locking tab 213 and a mounting frame 216. The plate 211 has an upper surface, a lower surface and a center. The central hole 212 is formed through the center of the plate 211 and aligns with the mounting hole 31 of the stationary member 30. Each of the at least one locking tab 213 is elastic, extends upwardly from the upper surface of the plate 211 adjacent to the central hole 212 and is detachably mounted through the mounting hole 31 of the stationary member 30. Each of the at least one locking tab 213 has a hook 214 extending from a distal end thereof to engage an edge of the mounting hole 31 of the stationary member 30. The mounting frame 216 extends from the lower surface of the plate 211. The blade holder 22 is received in the mounting frame 216 of the rack 21 and has a conical bore 221. The conical bore 221 is formed in the blade holder 22, aligns with the central hole 212 of the rack 21 and has a communicating slot. The blade 23 is secured to the blade holder 22 adjacent to the slot and has a cutting edge 231 entering the conical bore 221 through the slot.

The ratchet mechanism is mounted between the stationary member 30 and the cutter 20, allows the cutter 20 to rotate in a drive direction and prevents the cutter 20 from rotating in a non-drive direction relative to the stationary member 30 and the shavings receptacle 10. The ratchet mechanism includes a rotary member 215 and a brake member 33. The rotary member 215 is mounted on the upper surface of the plate 211 of the rack 21 and is disposed around the locking tab 213. The brake member 33 is mounted on a peripheral portion of the lower surface of the stationary member 30 and is disposed around the rotary member 215. When the cutter 20 is desired to rotate in the non-drive direction relative to the stationary member 30, as indicated by the solid line arrow in FIG. 5, the rotary member 215 will engage the brake member 33, thereby preventing the cutter 20 from rotating in the non-drive direction. When the cutter 20 is desired to rotate in the drive direction, as indicated by the broken line arrow in FIG. 5, the rotary member 215 will disengage the brake member 33, thereby allowing the cutter 20 to rotate in the drive direction. Consequently, the cutter 20 is rotatable in the drive direction and is non-rotatable in the non-drive direction relative to the stationary member 30 and the shavings receptacle 10 by the cooperation of the rotary member 215 and the brake member 33.

The cover 40 covers the open top of the shavings receptacle 10, is located above the stationary member 30 and includes a center, an upper surface, a lower surface, a bottom peripheral portion, a positioning hole 41, a plurality of elastic pieces 42 and an annular groove. The positioning hole 41 is formed through the center of the cover 40 and aligns with the mounting hole 31 of the stationary member 30. The elastic pieces 42 extend downwardly from the lower surface of the cover 40 around the positioning hole 41. The annular groove is formed in the bottom peripheral portion of the cover 40 for receiving a top section of the tube wall of the shavings receptacle 10.

Figure 4:
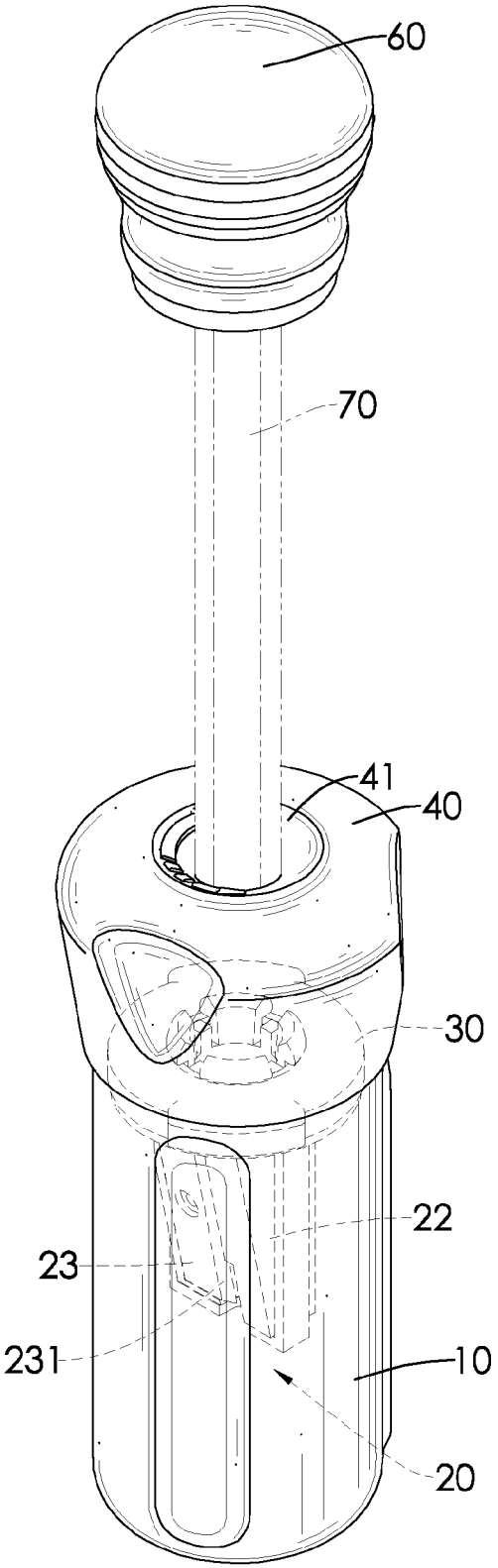
FIG. 4 is an operational perspective view of the first embodiment of the reciprocating pencil sharpener in FIG. 1 showing that a pencil is sharpened.

With further reference to FIG. 4, when a user desires to sharpen a pencil 70, the shavings receptacle 10 is held in one hand and the point of the pencil 70 is inserted into the conical bore 221 of the blade holder 22 of the cutter 20 through the positioning hole 41 of the cover 40 with the other hand. The pencil 70 is then rotated against the blade 23 in the non-drive direction. The blade 23 shaves away the wood and lead of the pencil 70 because the ratchet mechanism makes the cutter 20 unable to rotate relative the stationary member 30 and the shavings receptacle 10. After the user's hand holding the pencil 70 rotates an angle, the user can rotate the pencil 70 in the drive direction to allow the wrist to return to its original position. Meanwhile, the point of the pencil 70 abutting against an inner surface of the conical bore 221 drives the cutter 20 to rotate together. Therefore, the user can keep the pencil 70 in the hand and rotate the pencil 70 in reciprocating rotation without re-holding the pencil to sharpen the point of the pencil 70. Consequently, it is convenient for the user to apply a rotational force and a high efficiency of sharpening operation is achieved.

The said non-drive direction means the direction in which the pencil 70 inserted into the conical bore 221 of the blade holder 22 of the cutter 20 rotates toward the cutting edge 231 of the blade 23. The cutter 20 is in a stationary state relative to the stationary member 30 when the pencil 70 is rotated in the non-drive direction. The said non-drive direction is not limited in a clockwise or counterclockwise direction. The said drive direction means the direction in which the pencil 70 inserted into the conical bore 221 of the blade holder 22 of the cutter 20 rotates away from the cutting edge 231 of the blade 23. The pencil 70 can drive the cutter 20 to rotate relative to the stationary member 30 in the drive direction. The said drive direction is not limited in a clockwise or counterclockwise direction.

When the pencil 70 is passed through the positioning hole 41 of the cover 40, the elastic pieces 42 of the cover 40 abut around the penholder to ensure that the pencil 70 is positioned axially with the cutter 20 and to prevent breaking of the pencil lead during a sharpening operation.

When the cutter 20 is rotated relative the stationary member 30 and the shavings receptacle 10, the fins 12 inside the shavings receptacle 10 will slide the shavings of the pencil 70 which emerge through the slot of the cutter 20. Therefore, the shavings can be evenly distributed within the shavings receptacle 10 to prevent the shavings from accumulating at a side of the shavings receptacle 10.

A rubber sleeve 60 may be mounted on the distal end of the pencil 70 to extend the length of the penholder, thus providing that the pencil 70 with a short length can also be rotated in reciprocating rotation conveniently.

When the blade 23 of the cutter 20 becomes worn and dull after long time of use, the cutter 20 can be detached from the shavings receptacle 10 to be replaced. The whole pencil sharpener does not need to be replaced with a new one while other components are still in use, thereby achieving an objective of waste reduction.

The pencil sharpener of the present invention can also be used without the shavings receptacle 10 and the cover 40. When a user desires to sharpen a pencil by using the pencil sharpener without the shavings receptacle 10 and the cover 40, the stationary member 30 is held in one hand and the point of the pencil 70 is inserted into the conical bore 221 of the blade holder 22 of the cutter 20 with the other hand. The user can keep the pencil 70 in the hand and rotate the pencil 70 in reciprocating rotation to sharpen the point of the pencil 70.

Figure 7:
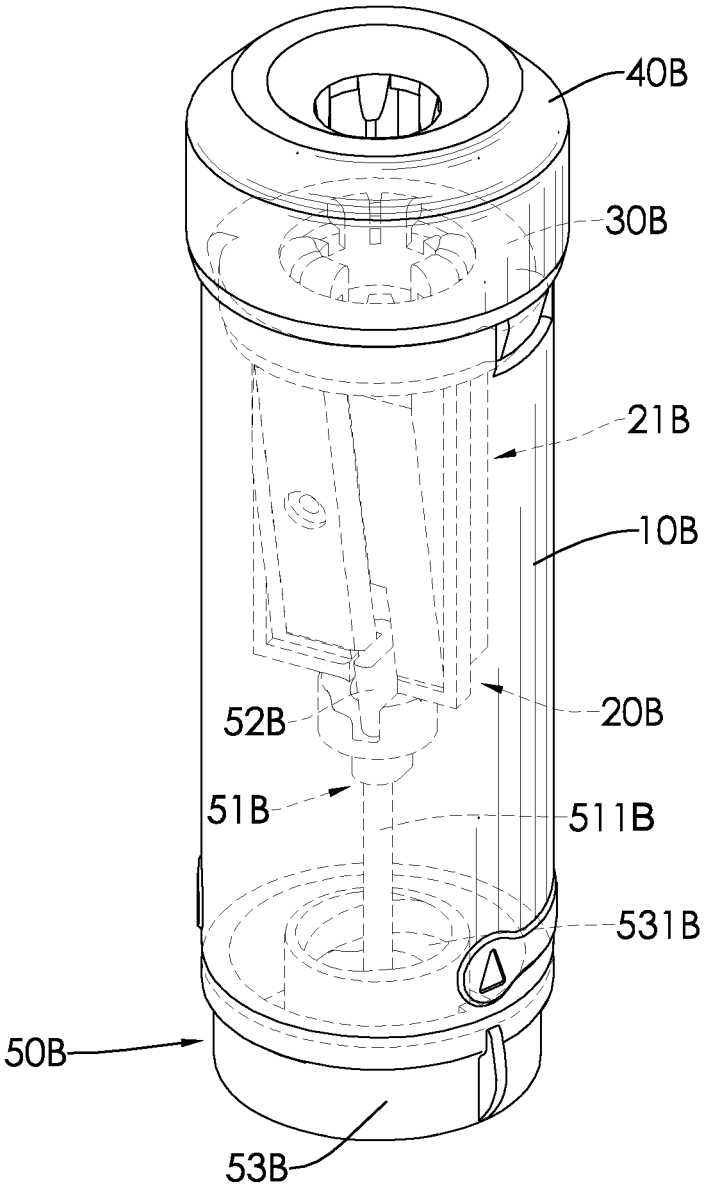
FIG. 7 is a perspective view of a third embodiment of the reciprocating pencil sharpener in accordance with the present invention.
Figure 8:
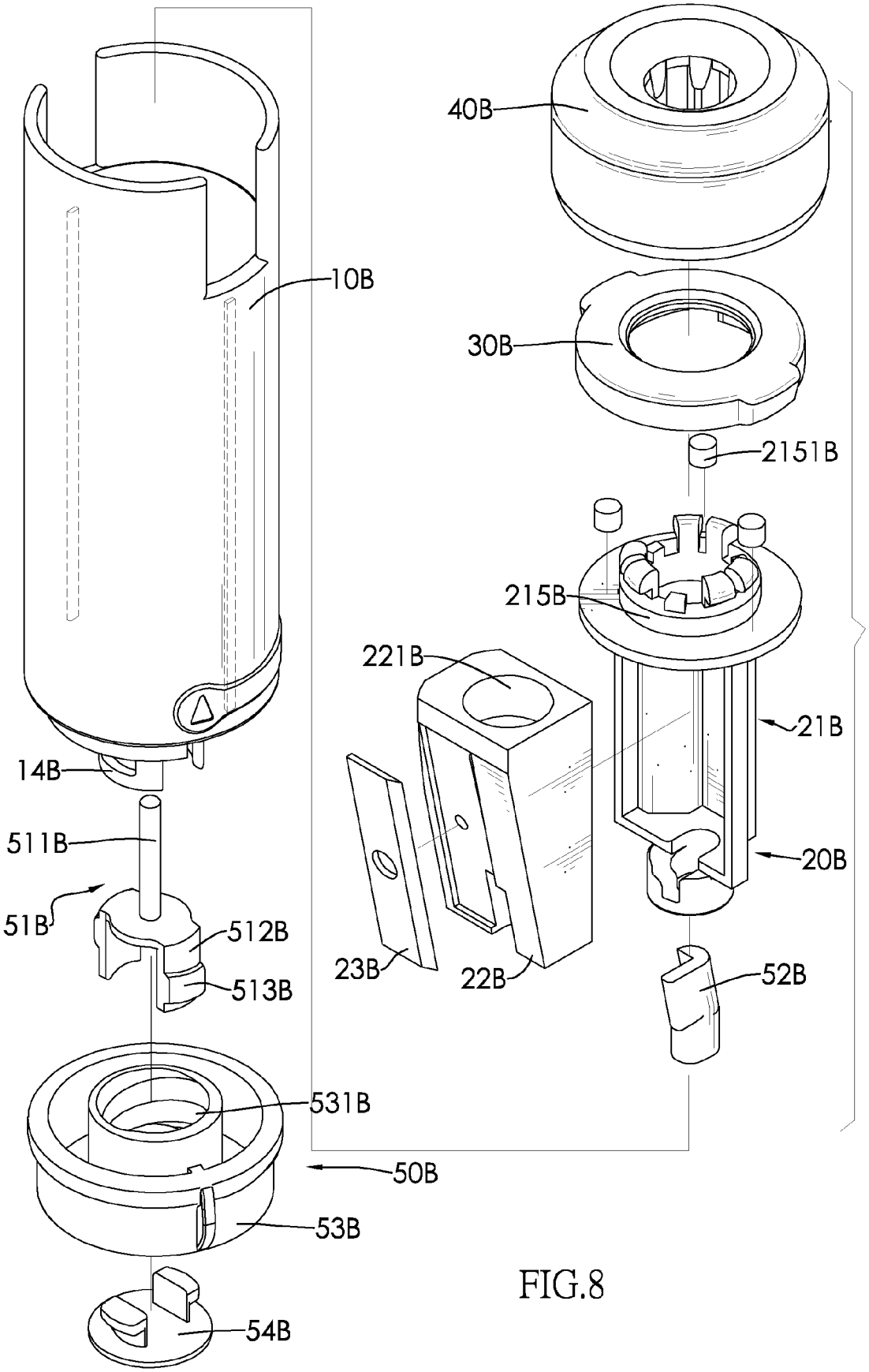
FIG. 8 is an exploded perspective view of the third embodiment of the reciprocating pencil sharpener in FIG. 7.
Figure 9:
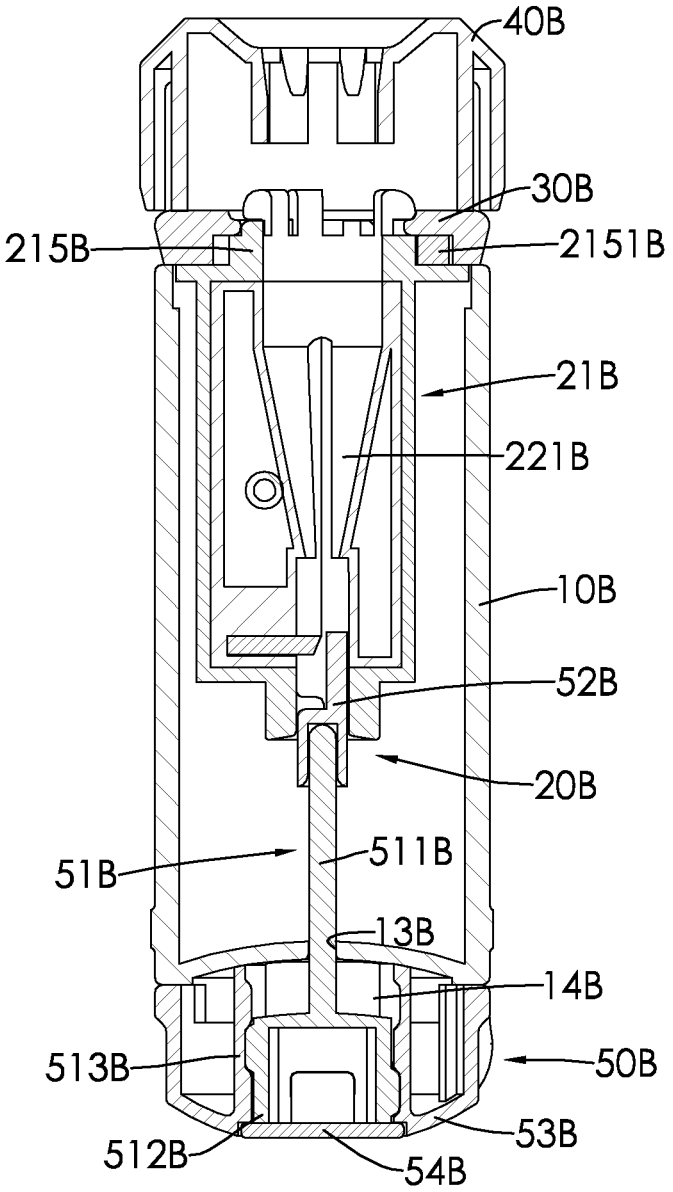
FIG. 9 is a cross-sectional side view of the third embodiment of the reciprocating pencil sharpener in FIG. 7.

With reference to FIGS. 7 to 9, the reciprocating pencil sharpener in accordance with the present invention further comprises an adjustment mechanism 50B and the shavings receptacle 10B further includes a through hole 13B and a plurality of connecting tabs 14B. The through hole 13B is formed through a center of the closed bottom of the shavings receptacle 10B. The connecting tabs 14B extend downwardly from a lower surface of the closed bottom of the shavings receptacle 10B around the through hole 13B.

The adjustment mechanism 50B includes a driven member MB, a block 52B, a rotary nut 53B and a plug MB. The driven member MB is mounted in the shavings receptacle 10B for axial movement and has a rod 511B and a plurality of positioning tabs 512B. The rod 511B is mounted through the through hole 13B of the shavings receptacle 10B and has a top end and a bottom end. The positioning tabs 512B are curved, extend downwardly from the bottom end of the rod 511B and are located outside of the shavings receptacle 10B. The positioning tabs 512B have thread portions 513B. Each positioning tab 512B is disposed between two adjacent sides of two adjacent connecting tabs 14B of the shavings receptacle 10B so as to limit axial movement of the driven member 51B. The block 52B is mounted on the top end of the rod 511B of the driven member 51B and is moved axially in a bottom of the conical bore 221B of the blade holder 22B. The rotary nut 53B is mounted around the positioning tabs 512B of the driven member 51B and the connecting tabs 14B of the shavings receptacle 10B and has a center and a threaded hole 531B. The threaded hole 531B is formed through the center of the rotary nut 53B and is screwed onto the thread portions 513B of the positioning tabs 512B of the driven member 51B. The plug 54B is attached to a bottom of the threaded hole 531B of the rotary nut 53B and is connected to the connecting tabs 14B of the shavings receptacle 10B.

The adjustment mechanism 50B is used to adjust a pencil to have a suitable sharpened pencil lead. An adjustment is made by rotating the rotary nut 53B to drive the driven member 51B to move axially and to change the axial position of the block 52B in the conical bore 221B of the blade holder 22B. The point of the pencil inserted into the conical bore 221B of the blade holder 22B can be sharpened until the pencil lead abuts the block 52B. Adjusting the block 52B deeply in the conical bore 221B of the blade holder 22B causes less pencil lead to be sharpened, thereby providing a blunt pencil lead. Adjusting the block 52B shallowly in the conical bore 221B of the blade holder 22B causes more pencil lead to be sharpened, thereby providing a sharp pencil lead.

With reference to FIGS. 1 to 5, in a first embodiment, the rotary member 215 has a periphery, a center, a plurality of elastic pawls 2151, a connecting hole 2152 and a plurality of recesses 2153. The pawls 2151 respectively extend outwardly from the periphery of the rotary member 215. The connecting hole 2152 is formed through the center of the rotary member 215 for allowing the at least one locking tab 213 of the rack 21 to be mounted therein. The recesses 2153 are formed in an inner surface of the connecting hole 2152 for receiving projections 217 on the plate 211 of the rack 21. The rotary member 215 and the rack 21 may be separate components connected together as shown or may be integrally formed as one-piece. The pawls 2151 of the rotary member 215 and the upper surface of the plate 211 of the rack 21 are spaced a distance apart when they are integrally formed. The brake member 33 has internal ratchet teeth 331 formed on the peripheral portion of the lower surface of the stationary member 30 for allowing the pawls 2151 of the rotary member 215 to selectively engage the internal ratchet teeth 331. That is, the pawls 2151 engage or disengage the internal ratchet teeth 331 in accordance with the rotational direction of sharpening operation.

Figure 5:
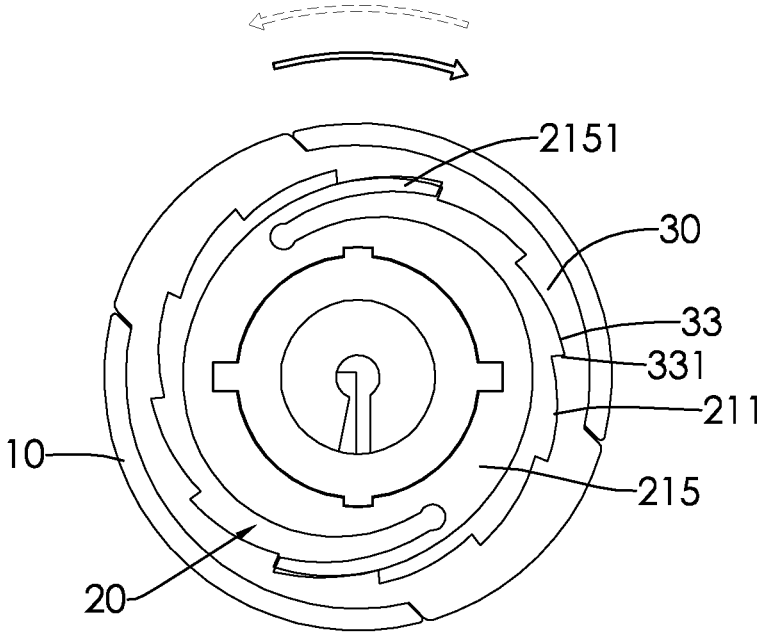
FIG. 5 is an enlarged cross-sectional top view of the first embodiment of the reciprocating pencil sharpener in FIG. 1.

When the first embodiment is used, the pencil 70 inserted into the conical bore 221 of the cutter 20 is rotated in the non-drive direction relative to the stationary member 30, as indicated by the solid line arrow in FIG. 5, the pawls 2151 of the rotary member 215 will engage the internal ratchet teeth 331 of the brake member 33, thereby preventing the cutter 20 from rotating in the non-drive direction. The pencil 70 is rotated in the drive direction, as indicated by the broken line arrow in FIG. 5, the pawls 2151 of the rotary member 215 will disengage the internal ratchet teeth 331 of the brake member 33, thereby allowing the cutter 20 to rotate in the drive direction. Consequently, the user can rotate the pencil 70 in reciprocating rotation so as to sharpen the point of the pencil 70.

In the first embodiment, the shavings receptacle 10 further includes multiple notches 11 respectively formed through the top section of tube wall. The stationary member 30 further includes multiple wings 32 respectively extending from a periphery thereof and received in the notches 11 of the shavings receptacle 10.

Figure 6:
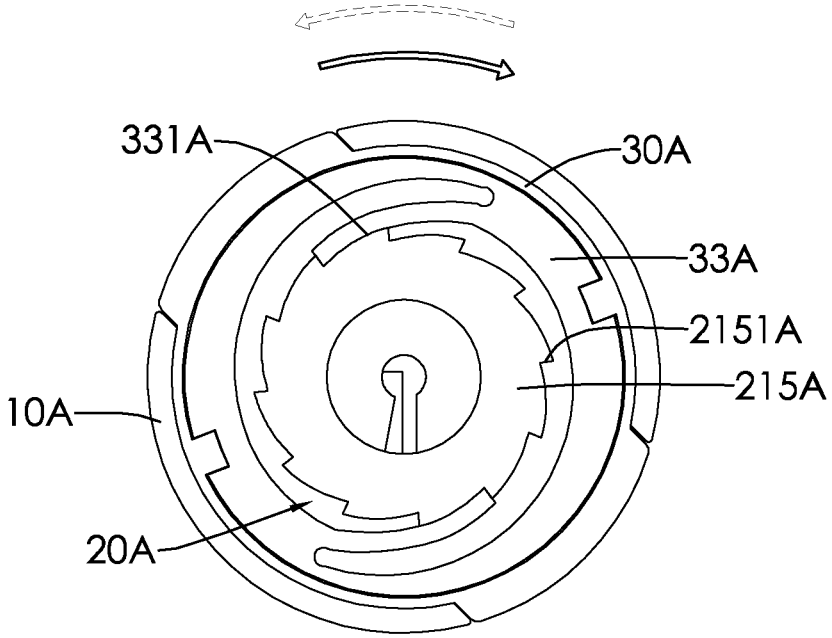
FIG. 6 is an enlarged cross-sectional top view of a second embodiment of the reciprocating pencil sharpener in accordance with the present invention.

With reference to FIG. 6, in a second embodiment based on the first embodiment, the rotary member 215A has external ratchet teeth 2151A formed on a periphery thereof and the brake member 33A is a ring and has an inner surface and a plurality of elastic pawls 331A. The pawls 331A respectively extend inwardly from the inner surface of the brake member 33A adapted to selectively engage the external ratchet teeth 2151A of the rotary member 215A. The brake member 33A and the stationary member 30A may be separate components connected together as shown or may be integrally formed as one-piece. The pawls 331A of the brake member 33A and the lower surface of the stationary member 30A are spaced a distance apart when they are integrally formed.

When the second embodiment is used, the pencil inserted into the cutter 20A is rotated in the non-drive direction relative to the stationary member 30A, as indicated by the solid line arrow in FIG. 6, the external ratchet teeth 2151A of the rotary member 215A will engage the pawls 331A of the brake member 33A, thereby preventing the cutter 20A from rotating in the non-drive direction. The pencil is rotated in the drive direction, as indicated by the broken line arrow in FIG. 6, the external ratchet teeth 2151A of the rotary member 215A will disengage the pawls 331A of the brake member 33A, thereby allowing the cutter 20A to rotate in the drive direction. Consequently, the user can rotate the pencil in reciprocating rotation so as to sharpen the point of the pencil.

In the first and second embodiments, the rotary member 215, 215A and the brake member 33, 33A have pawls and cooperating ratchet teeth. When the pencil inserted into the cutter 20, 20A is rotated in the non-drive direction, the pawls and the ratchet teeth will engage each other, thereby preventing the rotary member 215, 215A from rotating relative to the brake member 33, 33A in the non-drive direction. When the pencil is rotated in the drive direction, the pawls and the ratchet teeth will disengage each other, thereby allowing the rotary member 215, 215A to rotate relative to the brake member 33, 33A in the drive direction. As the rotary member 215, 215A rotate relative to the brake member 33, 33A, an accompanying audible click and vibration are produced to prompt the user that the rotation effect is achieved.

With reference to FIGS. 7 to 10, in a third embodiment, the rotary member 215B is a ring and the brake member 33B has internal ratchet teeth 331B formed on the peripheral portion of the lower surface of the stationary member 30B. Multiple elongated spaces are respectively formed between the internal ratchet teeth 331B and an outer surface of the rotary member 215B. At least one roller 2151B is received in the elongated spaces. Preferably, each elongated space receives one roller 2151B. The roller 2151B contacts the internal ratchet teeth 331B of the brake member 33B and the outer surface of the rotary member 215B. The roller 2151B may be a cylinder as shown or a ball.

Figure 10:
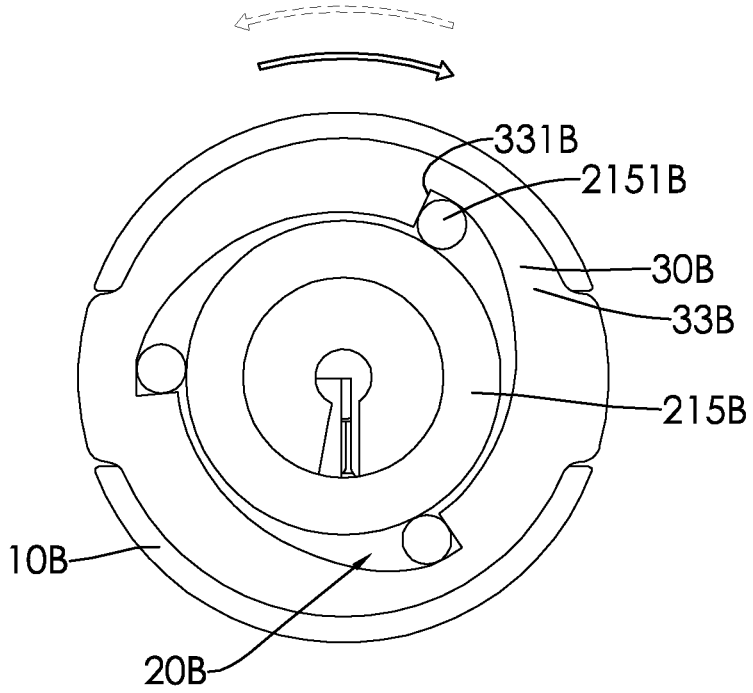
FIG. 10 is an enlarged cross-sectional top view of the third embodiment of the reciprocating pencil sharpener in FIG. 7.

When the third embodiment is used, the pencil inserted into the cutter 20B is rotated in the non-drive direction relative to the stationary member 30B, as indicated by the solid line arrow in FIG. 10, the rollers 2151B will be clamped in the elongated spaces between the internal ratchet teeth 331B of the brake member 33B and the outer surface of the rotary member 215B, thereby preventing the cutter 20B from rotating in the non-drive direction. The pencil is rotated in the drive direction, as indicated by the broken line arrow in FIG. 10, the rollers 2151B will disengage the internal ratchet teeth 331B of the brake member 33B and the outer surface of the rotary member 215B and rotatably abut sides of the internal ratchet teeth 331B of the brake member 33B, thereby allowing the cutter 20B to rotate in the drive direction. Consequently, the user can rotate the pencil in reciprocating rotation so as to sharpen the point of the pencil.

Figure 11:
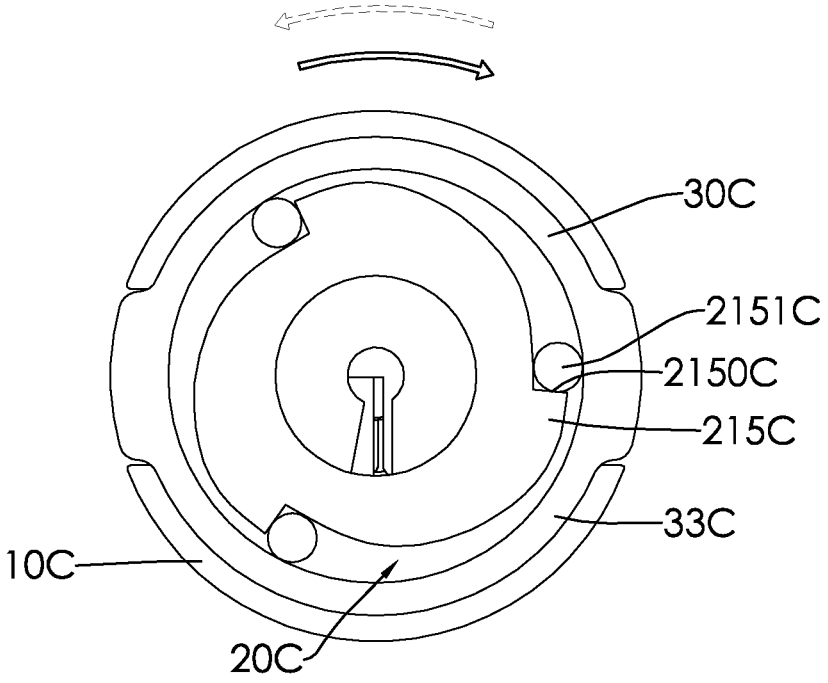
FIG. 11 is an enlarged cross-sectional top view of a fourth embodiment of the reciprocating pencil sharpener in accordance with the present invention.

With reference to FIG. 11, in a fourth embodiment based on the third embodiment, the rotary member 215C has external ratchet teeth 2150C and the brake member 33C is a ring formed on the peripheral portion of the lower surface of the stationary member 30C. Multiple elongated spaces are respectively formed between the external ratchet teeth 2150C of the rotary member 215C and an inner surface of the brake member 33C. At least one roller 2151C is received in the elongated spaces. Preferably, each elongated space receives one roller 2151C. The roller 2151C contacts the external ratchet teeth 2150C of the rotary member 215C and the inner surface of the brake member 33C.

When the fourth embodiment is used, the pencil inserted into the cutter 20C is rotated in the non-drive direction relative to the stationary member 30C, as indicated by the solid line arrow in FIG. 11, the rollers 2151C will be clamped in the elongated spaces between the external ratchet teeth 2150C of the rotary member 215C and the inner surface of the brake member 33C, thereby preventing the cutter 20C from rotating in the non-drive direction. The pencil is rotated in the drive direction, as indicated by the broken line arrow in FIG. 11, the rollers 2151C will disengage the external ratchet teeth 2150C of the rotary member 215C and the inner surface of the brake member 33C and be rotatable because of a push by the external ratchet teeth 2150C of the rotary member 215C, thereby allowing the cutter 20C to rotate in the drive direction. Consequently, the user can rotate the pencil in reciprocating rotation so as to sharpen the point of the pencil.

In the third and fourth embodiments, the rollers 2151B, 2151C are mounted between the rotary member 215B, 215C and the brake member 33B, 33C. When the pencil inserted into the cutter 20B, 20C is rotated in the non-drive direction, the rollers 2151B, 2151C will be clamped in the elongated spaces between the rotary member 215B, 215C and the brake member 33B, 33C, thereby preventing the rotary member 215B, 215C from rotating relative to the brake member 33B, 33C in the non-drive direction. When the pencil is rotated in the drive direction, the rollers 2151B, 2151C will disengage the rotary member 215B, 215C and the brake member 33B, 33C, thereby allowing the rotary member 215B, 215C to rotate relative to the brake member 33B, 33C in the drive direction. As the rotary member 215B, 215C rotates relative to the brake member 33B, 33C, no accompanying audible click and vibration are produced to ensure smooth and silent rotation.

Figure 12:
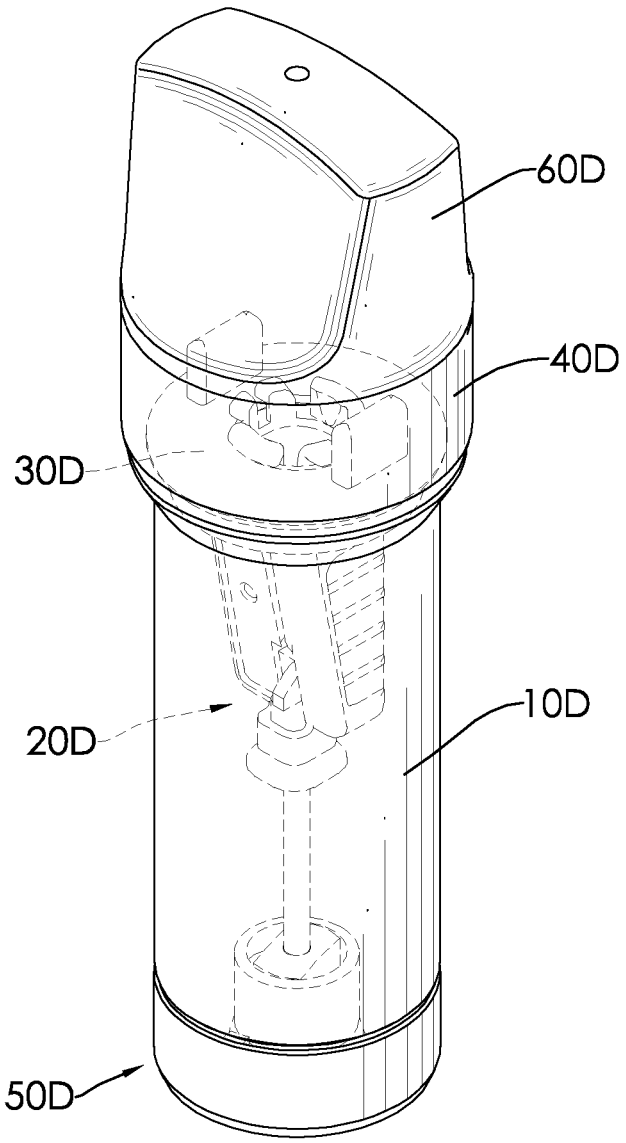
FIG. 12 is a perspective view of a fifth embodiment of the reciprocating pencil sharpener in accordance with the present invention.
Figure 13:
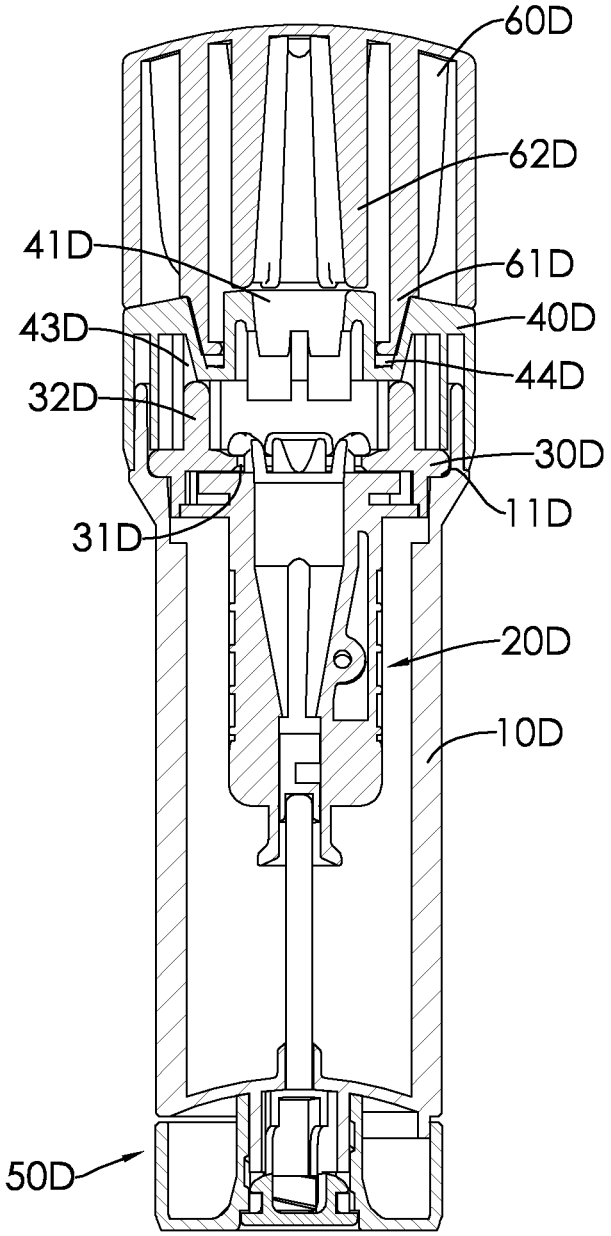
FIG. 13 is a cross-sectional side view of the fifth embodiment of the reciprocating pencil sharpener in FIG. 12.
Figure 14:
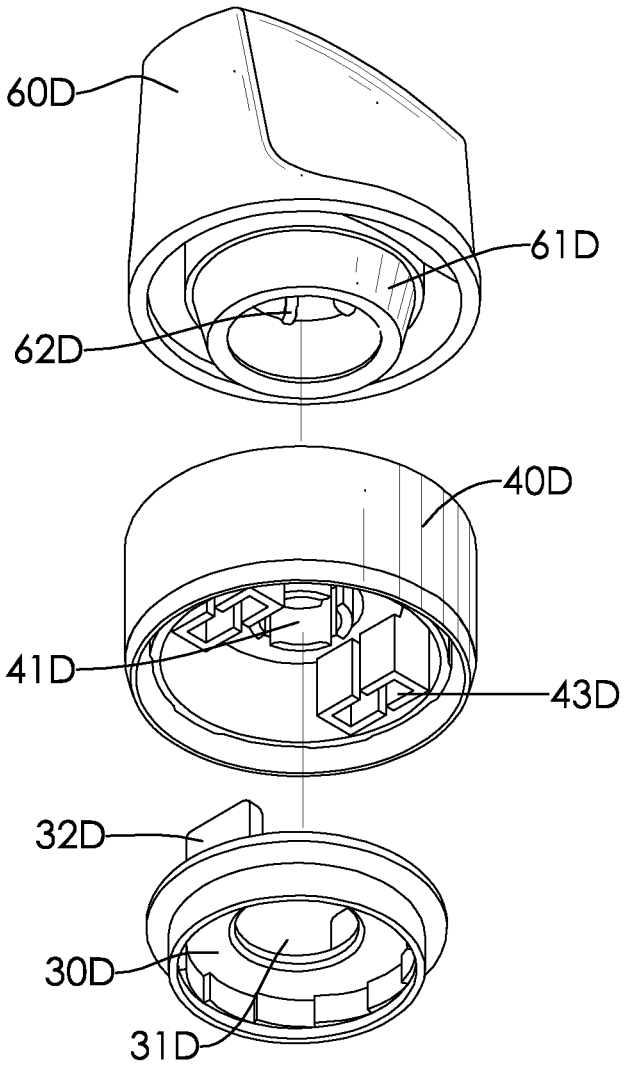
FIG. 14 is a partial exploded perspective view of the fifth embodiment of the reciprocating pencil sharpener in FIG. 12.

With reference to FIGS. 12 to 14, in a fifth embodiment based on the foregoing embodiment, the shavings receptacle 10D further includes a step surface 11D formed around the internal surface of the tube wall adjacent to the open top as shown in FIG. 13. The stationary member 30D further includes a rim and multiple protrusions 32D. The rim of the stationary member 30D abuts the step surface 11D of the shavings receptacle 10D. The protrusions 32D extend upwardly from the upper surface of the stationary member 30D around the mounting hole 31D. The cover 40D further includes multiple receiving parts 43D formed on the lower surface thereof for receiving the protrusions 32D of the stationary member 30D so as to connect the cover 40D to the stationary member 30D. When it is desired to dump the pencil shavings collected inside the shavings receptacle 10D, the cover 40D can be detached from the shavings receptacle 10D together with the stationary member 30D. Therefore, it is convenient to dump the pencil shavings because only one action is required by a user.

In the fifth embodiment, the rubber sleeve 60D is detachably mounted on the cover 40D. The cover 40D further includes an annular channel 44D formed in the upper surface thereof around the positioning hole 41D. The rubber sleeve 60D includes an annular piece 61D extending from a lower surface thereof and received in the annular channel 44D of the cover 40D. When it is desired to sharpen a pencil, the rubber sleeve 60D is detached from the cover 40D and is then mounted on the distal end of the pencil 70 to extend the length of the penholder. Further, the rubber sleeve 60D includes a plurality of elastic bars 62D formed therein to abut around the penholder so that a user can hold the pencil steadily. Upon completion of the pencil sharpening operation, the rubber sleeve 60D is re-mounted on the cover 40D for easy carrying.

Figure 15:
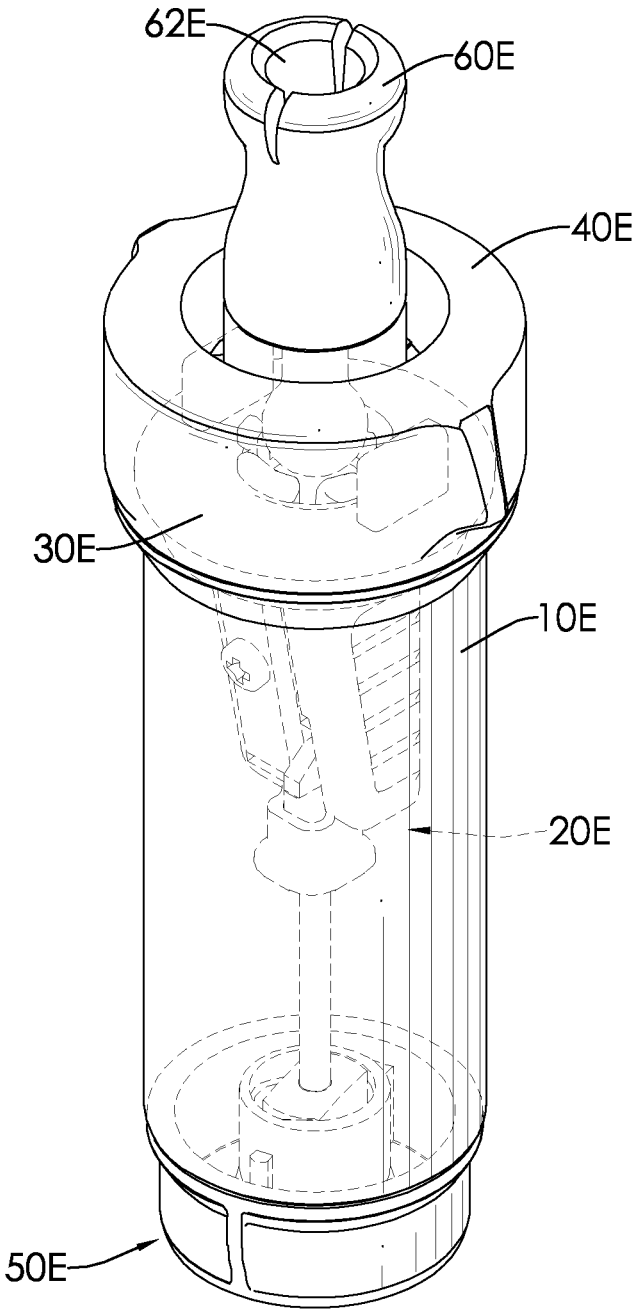
FIG. 15 is a perspective view of a sixth embodiment of the reciprocating pencil sharpener in accordance with the present invention.
Figure 16:
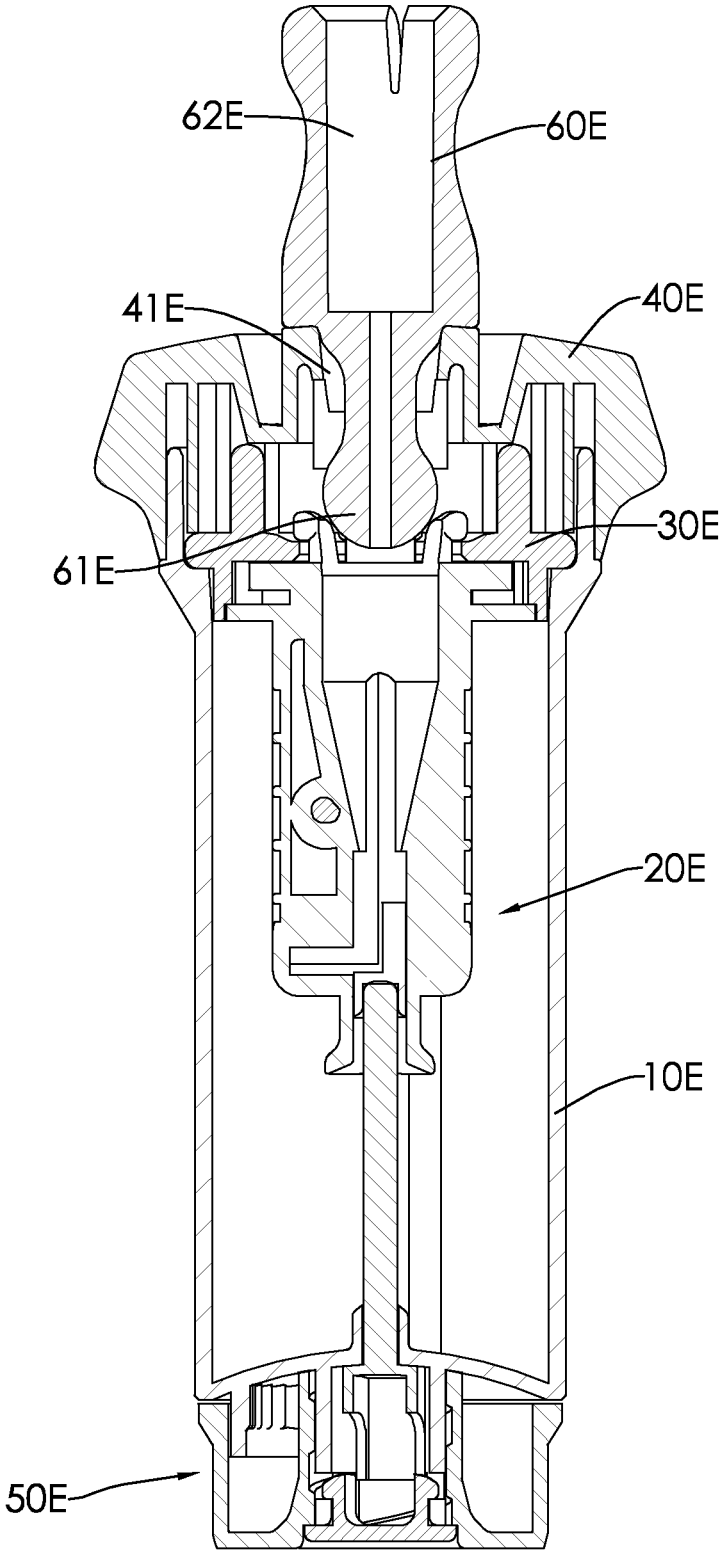
FIG. 16 is a cross-sectional side view of the sixth embodiment of the reciprocating pencil sharpener in FIG. 15.
Figure 17:
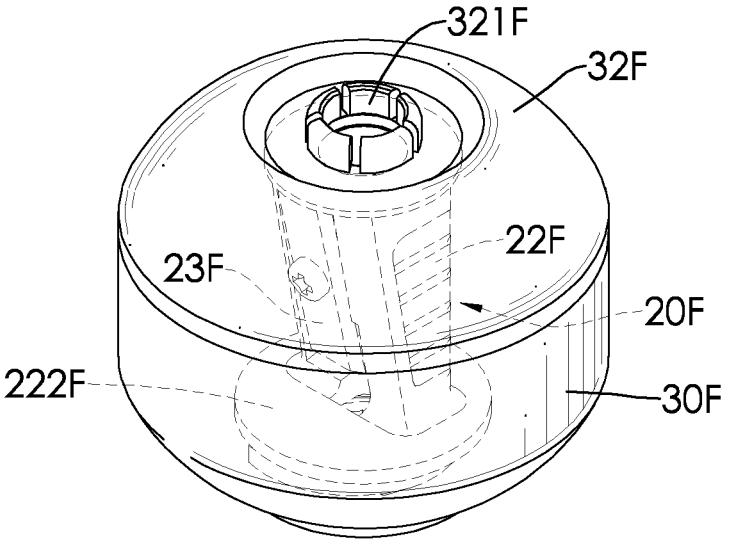
FIG. 17 is a perspective view of a seventh embodiment of the reciprocating pencil sharpener in accordance with the present invention.
Figure 18:
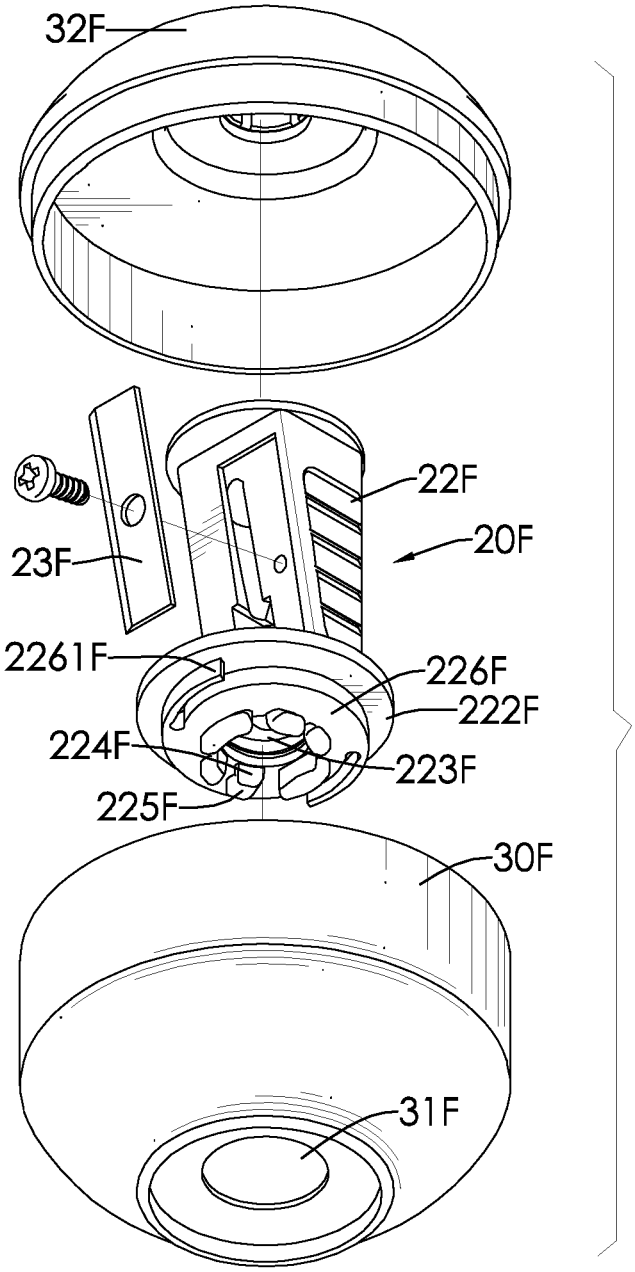
FIG. 18 is an exploded perspective view of the seventh embodiment of the reciprocating pencil sharpener in FIG. 17.
Figure 19:
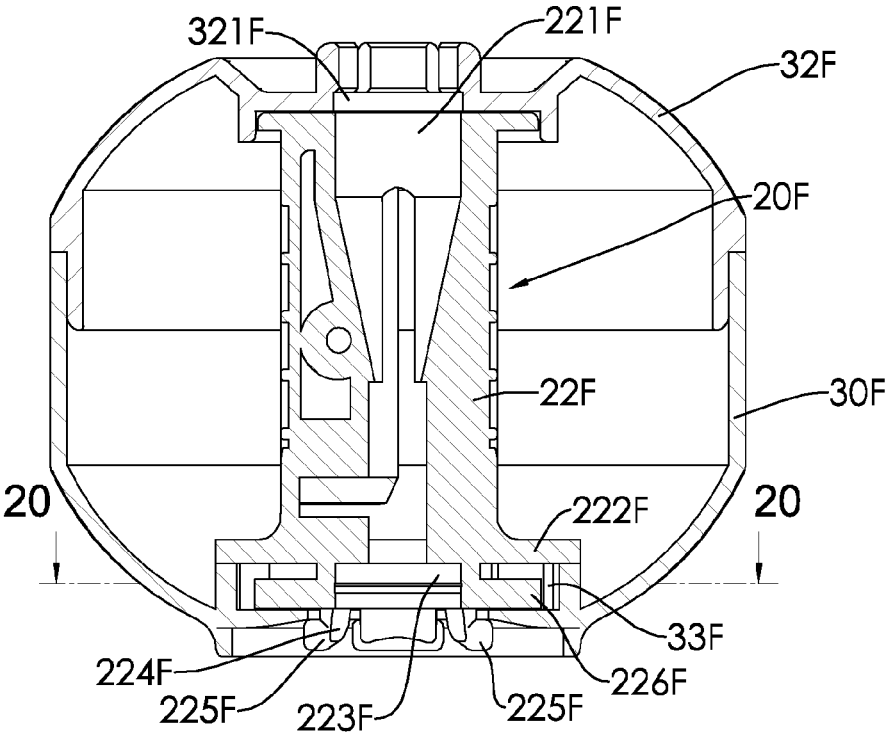
FIG. 19 is a cross-sectional side view of the seventh embodiment of the reciprocating pencil sharpener in FIG. 18.

With reference to FIGS. 15 and 16, in a sixth embodiment based on the fifth embodiment, the rubber sleeve 60E is detachably mounted on the cover 40E, is nipple-shaped and includes a top end, a bottom end, a ball portion 61E and an elongated recess 62E. The ball portion 61E is formed at the bottom end of the rubber sleeve 60E and is received in the positioning hole 41E of the cover 40E. A diameter of the ball portion 61E is not smaller than a diameter of the positioning hole 41E of the cover 40E. The elongated recess 62E is formed in the top end of the rubber sleeve 60E. When it is desired to sharpen a pencil, the rubber sleeve 60E is detached from the cover 40E and the distal end of the pencil 70 is received in the elongated recess 62E of the rubber sleeve 60E so as to extend the length of the penholder.

With reference to FIGS. 17 to 20, in a seventh embodiment, the reciprocating pencil sharpener comprises only a stationary member, a cutter 20F and a ratchet mechanism.

The stationary member includes a base 30F, a cover 32F and a chamber. The base 30F has a mounting hole 31F formed through a center thereof. The cover 32F covers the base 30F and has a positioning hole 321F formed through a center thereof. The chamber is defined between the base 30F and the cover 32F.

The cutter 20F is detachably mounted in the chamber of the stationary member and includes a blade 23F secured to a blade holder 22F. The blade holder 22F has a bottom, a conical bore 221F, a plate 222F, a plate hole 223F and at least one locking tab 224F. The conical bore 221F is formed in the blade holder 22F. The plate 222F is formed at the bottom of the blade holder 22F and has a lower surface and a center. The plate hole 223F is formed through the center of the plate 222F and aligns with the mounting hole 31F of the stationary member. Each of the at least one locking tab 224F is elastic, extends downwardly from the lower surface of the plate 222F adjacent to the plate hole 223F and is detachably mounted through the mounting hole 31F of the stationary member. Each of the at least one locking tab 224F has a hook 225F extending from a distal end thereof to engage an edge of the mounting hole 31F of the stationary member.

The ratchet mechanism is mounted between the base 30F of the stationary member and the cutter 20F and allows the cutter 20F to rotate relative to the stationary member in one direction only. The ratchet mechanism includes a rotary member 226F and a brake member 33F. The rotary member 226F is mounted on the lower surface of the plate 222F of the blade holder 22F and is disposed around the plate hole 223F. The brake member 33F is mounted on a peripheral portion of an upper surface of the base 30F and is disposed around the rotary member 226F. When the cutter 20F is desired to rotate in the non-drive direction relative to the stationary member, as indicated by the solid line arrow in FIG. 20, the rotary member 226F will engage the brake member 33F, thereby preventing the cutter 20F from rotating in the non-drive direction. When the cutter 20F is desired to rotate in the drive direction, as indicated by the broken line arrow in FIG. 20, the rotary member 226F will disengage the brake member 33F, thereby allowing the cutter 20F to rotate in the drive direction.

Figure 20:
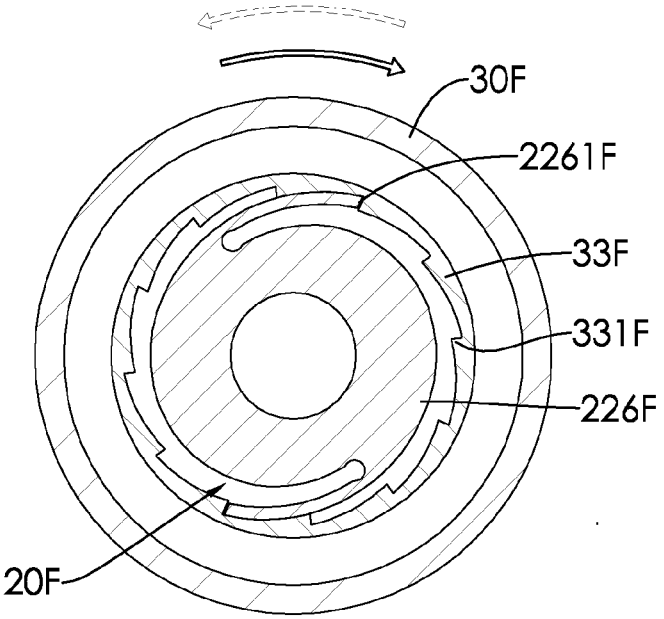
FIG. 20 is a cross-sectional bottom view of the reciprocating pencil sharpener along line 20-20 in FIG. 19.

With reference to FIG. 20, in a preferred embodiment, the rotary member 226F has a periphery, a center, and a plurality of elastic pawls 2261F. The pawls 2261F respectively extend outwardly from the periphery of the rotary member 226F. The rotary member 226F is integrally formed as one-piece with the plate 222F of the blade holder 22F. The pawls 2261F of the rotary member 226F and the lower surface of the plate 222F of the blade holder 22F are spaced a distance apart. The brake member 33F has internal ratchet teeth 331F formed on the peripheral portion of the upper surface of the base 30F for allowing the pawls 2261F of the rotary member 226F to selectively engage the internal ratchet teeth 331F.

When the seventh embodiment is used, the pencil is inserted into the conical bore 221F of the cutter 20F through the positioning hole 321F of the cover 32F. The pencil is then rotated in the non-drive direction relative to the stationary member, as indicated by the solid line arrow in FIG. 20, the pawls 2261F of the rotary member 226F will engage the internal ratchet teeth 331F of the brake member 33F, thereby preventing the cutter 20F from rotating in the non-drive direction. The pencil is rotated in the drive direction relative to the stationary member, as indicated by the broken line arrow in FIG. 20, the pawls 2261F of the rotary member 226F will disengage the internal ratchet teeth 331F of the brake member 33F, thereby allowing the cutter 20F to rotate in the drive direction. Consequently, the user can rotate the pencil in reciprocating rotation so as to sharpen the point of the pencil. The seventh embodiment comprising only the stationary member, the cutter 20F and the ratchet mechanism without the shavings receptacle and the cover can also be operated well.

Even though numerous characteristics and advantages of the present invention have been set forth in the foregoing description, together with details of the structure and features of the invention, the disclosure is illustrative only. Changes may be made in the details, especially in matters of shape, size and arrangement of parts within the principles of the invention to the full extent indicated by the broad general meaning of the terms in which the appended claims are expressed.

What is claimed is:

1. A reciprocating pencil sharpener comprising:

a stationary member;

a cutter including a blade holder and a blade secured to the blade holder; and a ratchet mechanism mounted between the stationary member and the cutter, allowing the cutter to rotate in a drive direction and preventing the cutter from rotating in a non-drive direction relative to the stationary member, wherein the stationary member includes a mounting hole formed therein; and the cutter includes at least one locking tab extending from a top thereof and mounted through the mounting hole of the stationary member, each of the at least one locking tab having a hook extending from a distal end thereof to engage an edge of the mounting hole of the stationary member.

2. The reciprocating pencil sharpener as claimed in claim 1, wherein the ratchet mechanism includes a rotary member mounted on the cutter; and a brake member mounted on the stationary member and disposed around the rotary member.

3. The reciprocating pencil sharpener as claimed in claim 2, wherein the rotary member of the ratchet mechanism has a plurality of pawls extending outwardly from a periphery thereof; and the brake member of the ratchet mechanism has internal ratchet teeth which the pawls of the rotary member selectively engage.

4. The reciprocating pencil sharpener as claimed in claim 2, wherein the rotary member of the ratchet mechanism has external ratchet teeth; and the brake member of the ratchet mechanism has a plurality of pawls extending inwardly from an inner surface thereof adapted to selectively engage the external ratchet teeth of the rotary member.

5. The reciprocating pencil sharpener as claimed in claim 2, wherein the rotary member of the ratchet mechanism is a ring; and the brake member of the ratchet mechanism has internal ratchet teeth, and at least one roller is received between the internal ratchet teeth and the rotary member and contacts the internal ratchet teeth and an outer surface of the rotary member.

6. The reciprocating pencil sharpener as claimed in claim 2, wherein the rotary member of the ratchet mechanism has external ratchet teeth; and the brake member of the ratchet mechanism is a ring, and at least one roller is received between the external ratchet teeth of the rotary member and the brake member and contacts the external ratchet teeth of the rotary member and an inner surface of the brake member.

7. The reciprocating pencil sharpener as claimed in claim 1 further comprising a shavings receptacle including an open top and a closed bottom, the stationary member mounted in the shavings receptacle and the cutter rotatably disposed in the shavings receptacle.

8. The reciprocating pencil sharpener as claimed in claim 7 further comprising an adjustment mechanism including a driven member mounted in the shavings receptacle for axial movement and having a rod mounted through the shavings receptacle; and a block mounted on a top end of the rod of the driven member and moved axially in a bottom of the blade holder.

9. The reciprocating pencil sharpener as claimed in claim 8, wherein the shavings receptacle includes a through hole formed through the closed bottom of the shavings receptacle and the rod of the driven member of the adjustment mechanism mounted through the through hole of the shavings receptacle; and a plurality of connecting tabs extending from a lower surface of the closed bottom of the shavings receptacle around the through hole;

the driven member of the adjustment mechanism has a plurality of positioning tabs extending from a bottom end of the rod, located outside of the shavings receptacle and having thread portions, and each positioning tab is disposed between two adjacent sides of two adjacent connecting tabs of the shavings receptacle; and the adjustment mechanism further includes a rotary nut mounted around the positioning tabs of the driven member and the connecting tabs of the shavings receptacle and having a threaded hole screwed onto the thread portions of the positioning tabs of the driven member.

10. The reciprocating pencil sharpener as claimed in claim 7, wherein the shavings receptacle includes a plurality of fins extending inwardly from an internal surface of a tube wall thereof.

11. The reciprocating pencil sharpener as claimed in claim 7 further comprising a cover covering the open top of the shavings receptacle, located above the stationary member and including a positioning hole formed through the cover; and a plurality of elastic pieces extending from the cover around the positioning hole.

12. The reciprocating pencil sharpener as claimed in claim 7, wherein the shavings receptacle includes multiple notches formed through a top section of a tube wall thereof; and the stationary member includes multiple wings extending from a periphery thereof and received in the notches of the shavings receptacle.

13. The reciprocating pencil sharpener as claimed in claim 11 further comprising a rubber sleeve detachably mounted on the cover.

14. The reciprocating pencil sharpener as claimed in claim 13, wherein the cover includes an annular channel formed in an upper surface thereof around the positioning hole; and the rubber sleeve includes an annular piece extending from a lower surface thereof and received in the annular channel of the cover.

15. The reciprocating pencil sharpener as claimed in claim 13, wherein the rubber sleeve includes a top end;

a bottom end;

a ball portion formed at the bottom end of the rubber sleeve and received in the positioning hole of the cover, a diameter of the ball portion being not smaller than a diameter of the positioning hole of the cover; and an elongated recess formed in the top end of the rubber sleeve.

16. The reciprocating pencil sharpener as claimed in claim 11, wherein the shavings receptacle includes a step surface formed around an internal surface of a tube wall adjacent to the open top;

the stationary member includes a rim abutting the step surface of the shavings receptacle; and multiple protrusions extending from an upper surface of the stationary member; and the cover includes multiple receiving parts formed on a lower surface thereof for receiving the protrusions of the stationary member so as to connect the cover to the stationary member.

17. The reciprocating pencil sharpener as claimed in claim 16 further comprising a rubber sleeve detachably mounted on the cover.

18. The reciprocating pencil sharpener as claimed in claim 17, wherein the cover includes an annular channel formed in an upper surface thereof around the positioning hole; and the rubber sleeve includes an annular piece extending from a lower surface thereof and received in the annular channel of the cover.

19. The reciprocating pencil sharpener as claimed in claim 17, wherein the rubber sleeve includes a top end;

a bottom end;

a ball portion formed at the bottom end of the rubber sleeve and received in the positioning hole of the cover, a diameter of the ball portion being not smaller than a diameter of the positioning hole of the cover; and an elongated recess formed in the top end of the rubber sleeve.

20. A reciprocating pencil sharpener comprising:

a stationary member;

a cutter including a blade holder and a blade secured to the blade holder; and a ratchet mechanism mounted between the stationary member and the cutter, allowing the cutter to rotate in a drive direction and preventing the cutter from rotating in a non-drive direction relative to the stationary member, wherein the stationary member includes a mounting hole formed therein; and the cutter includes at least one locking tab extending from a bottom thereof and mounted through the mounting hole of the stationary member, each of the at least one locking tab having a hook extending from a distal end thereof to engage an edge of the mounting hole of the stationary member.

21. The reciprocating pencil sharpener as claimed in claim 20, wherein the stationary member includes a base;

a cover covering the base; and a chamber defined between the base and the cover; and the cutter is mounted in the chamber of the stationary member.

* * * * *